US007273154B1

(12) United States Patent
Edwards

(10) Patent No.: US 7,273,154 B1
(45) Date of Patent: Sep. 25, 2007

(54) PORTABLE CLOTHESLINE ASSEMBLY FOR VEHICLES

(76) Inventor: Eugene B. Edwards, 1528 E. Old Spring Hope Rd., Nashville, NC (US) 27856

( * ) Notice: Subject to any disclaimer, the term of this patent is extended or adjusted under 35 U.S.C. 154(b) by 312 days.

(21) Appl. No.: 11/130,786

(22) Filed: May 18, 2005

(51) Int. Cl.
*A47G 29/087* (2006.01)
*D06F 53/00* (2006.01)

(52) U.S. Cl. ..... 211/119.01; 211/195; 211/94.03

(58) Field of Classification Search ..... 211/119.01, 211/119.1, 85.3, 105.1, 94.03, 123; 52/127.2, 52/720.1; 248/686, 560; 224/587; 220/493; 206/300

See application file for complete search history.

(56) References Cited

U.S. PATENT DOCUMENTS 2,887,233 A * 5/1959 Bybee ..... 211/85.3
3,675,785 A * 7/1972 Martin ..... 211/119.1
3,782,766 A * 1/1974 Teel ..... 293/117
4,363,507 A * 12/1982 Bays ..... 293/128
4,662,132 A * 5/1987 Tennant ..... 52/148
5,582,304 A * 12/1996 Dishon, Jr. ..... 211/119.1
D402,187 S * 12/1998 Caudle ..... D8/363

OTHER PUBLICATIONS

Product Name: Porta Clothesline; www.campingworld.com.*
ACAR Industries, Inc.; RV Portable Clothesline Part No. 593, 05930; http://www.acar4hitches.com/acar4hitches/_pdf/Camping%20Accessories.pdf.*
Title of Source: www.campingworld.com Product Name: Porta Clothesline.

* cited by examiner

*Primary Examiner*—George B. Nguyen
*Assistant Examiner*—Samuel S Lin

(57) ABSTRACT

An assembly includes a housing that has a tubular shape provided with opposed open ends, a planar top surface with spaced apertures adjacent to the ends thereof, and is formed from durable and non-corrosive material. Couplings are insertable into the open ends and are adaptable along a longitudinal axis of the housing. Each coupling has a core provided with a linear bore formed at an angle offset from a vertical axis and a hole formed therein which is positional with an associated one of the apertures. Quick-release pins are insertable into corresponding ones of the apertures and holes, maintaining the couplings at a static relationship with the housing. Coextensive support shafts are interfittable into the bores after the couplings are displaced from the housing. A flexible cord has opposed ends tethered to the support shafts so that the cord maintains a sufficient tension for supporting wet clothes therefrom.

15 Claims, 4 Drawing Sheets

PORTABLE CLOTHESLINE ASSEMBLY FOR VEHICLES

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

This invention relates to clothes line assemblies and, more particularly, to a portable clothesline assembly for vehicles.

2. Prior Art

On extended camping trips of more than a few days, people often find it necessary to launder their clothes. However, many recreational vehicles, or campers, are not provided with any means for laundering or drying clothes. Although the clothes can be washed in the sink or a small plastic basin, drying them is still a problem. Thus, people are often required to suspend wet clothes from tree limbs or other insufficient structures.

Various proposed clothesline devices are potentially adaptable for use in camper vehicles. One example shows a rod compressed between opposite walls of a shower stall. Clotheslines are stretched between brackets at opposite ends of the rod. If this device is sized for use in the very small shower in a camper vehicle, it will be so short that it can hang just a few small items of clothing. Another example shows a chain hung between two mounting strips attached on opposite walls. Although it can be adapted for mounting in a camper, such as in the shower, the chain will have to be so short that it will be of little practical use. The metal construction also has a tendency to rust when exposed to wet clothes, which renders the device useless.

Finally, yet another prior art example shows a portable clothesline device with a pair of clamps for clamping onto a window sill. It includes a complicated mechanism for deploying and retracting clotheslines between a pair of arms. If it is sized for mounting on the narrow windows of a camper, the arms will be very close together, so that the clotheslines will be too short to be of much use. Apart from their insufficient size, these examples share another crucial disadvantage among themselves. They are all designed to be employed on the interior of a camper or recreational vehicle, where clothes would take longer to dry than if hung on the exterior and in the sun.

Accordingly, a need remains for a portable clothesline assembly for vehicles in order to overcome the above-noted shortcomings. The present invention satisfies such a need by providing a portable clothesline assembly that is easy and convenient to use, and provides the user with considerable time savings. Such a portable clothesline assembly eliminates the need to place wet clothes on awning supports or suspending them from tree limbs. The assembly provides a considerable amount of space in order to hang towels, bathing suits, and other clothes simultaneously in direct sunlight. This advantageously saves the user's time and ensures that the items are properly dried or aired out.

BRIEF SUMMARY OF THE INVENTION

In view of the foregoing background, it is therefore an object of the present invention to provide a portable clothesline assembly for vehicles. These and other objects, features, and advantages of the invention are provided by a clothesline assembly for use during camping trips and the like.

The clothesline assembly includes an elongated housing that has a tubular shape provided with axially opposed open end portions abutted adjacent to a rear portion of the vehicle. Such a housing has a planar top surface provided with a plurality of spaced apertures formed adjacent to the end portions thereof, and is formed from durable and non-corrosive material.

A plurality of couplings are directly insertable into the open end portions of the housing in such a manner that the couplings are laterally adaptable along a centrally registered longitudinal axis of the housing. Each coupling has a solid core provided with a substantially linear bore formed at an angle offset from a vertical axis.

Each bore may be provided with a longitudinal axis outwardly flaring away from a center of the housing for advantageously assisting the cord to maintain a consistent and sufficient tension during operating conditions. The longitudinal axes of the bores may be outwardly flanged away from a rear surface of the vehicle for effectively providing adequate space along which to hang clothing garments and the like. Each coupling further has a hole formed therein which is vertically positional with an associated one of the apertures during assembly procedures. Such holes are preferably medially disposed from the bores such that a user must remove the pins from the apertures prior to positioning the support shafts into the bores. A plurality of quick-release pins are removably insertable into corresponding ones of the apertures and holes for effectively maintaining the couplings at a static spatial relationship with the housing during traveling conditions.

A plurality of coextensive elongated and linear support shafts are sized and shaped for being stored within the housing during traveling conditions. Such support shafts are interfittable directly into the bores after the couplings are partially and laterally displaced from the housing. The support shafts preferably have top end portions provided with a plurality of eyelets for respectively receiving the end portions of the cord therethrough.

A flexible cord that has opposed end portions is detachably tethered to the support shafts in such a manner that the cord maintains a sufficient tension for conveniently and advantageously supporting wet clothes therefrom during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
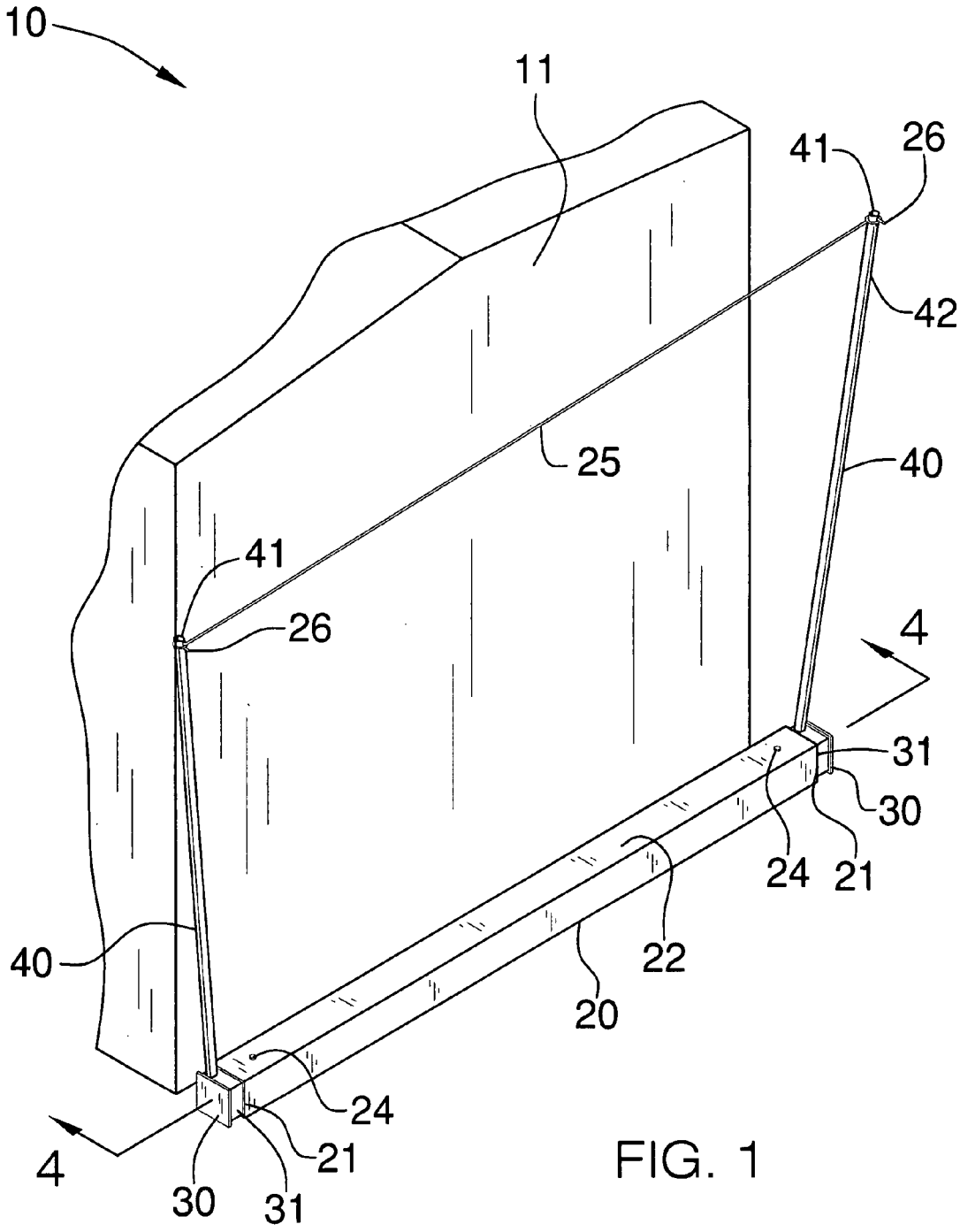
FIG. 1 is a perspective view showing a portable clothesline assembly for vehicles, in accordance with the present invention.
Figure 2:
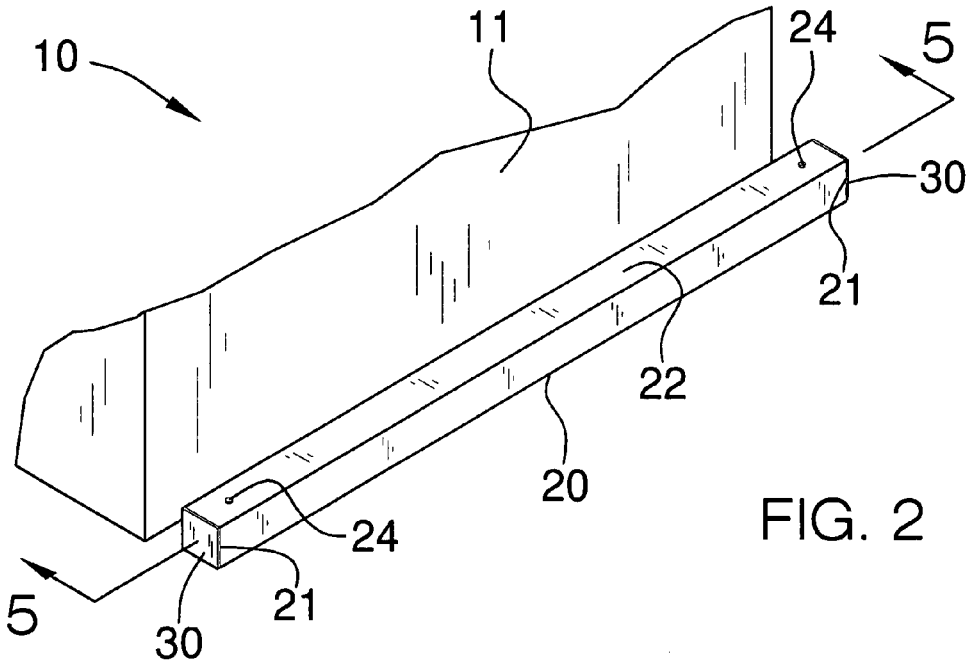
FIG. 2 is a perspective view of the assembly shown in FIG. 1, showing the support shafts removed therefrom.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-8 by the reference numeral 10 and is intended to provide a portable clothesline assembly for vehicles. It should be understood that the assembly 10 may be used to suspend clothes from many different types of vehicles and should not be limited in use to only recreational vehicles.

Referring initially to FIG. 1, the assembly 10 includes an elongated housing 20 that has a tubular shape provided with axially opposed open end portions 21 abutted adjacent to a rear portion 12 of the vehicle 11. Of course, such a housing 20 may be positioned along any suitable surface of a variety of vehicles, as is obvious to a person of ordinary skill in the art. Positioning the housing 20 at an exterior of the vehicle 11, however, does grant exposure to direct sunlight for more expedient drying and airing out of wet clothes. Such a housing 20 has a planar top surface 22 provided with a plurality of spaced apertures 23 formed adjacent to the end portions 21 thereof, and is formed from durable and non-corrosive material, advantageously preventing the housing 20 from deteriorating when exposed to undesirable environmental elements.

Referring to FIGS. 1 through 7, a plurality of couplings 30 are directly insertable, with no intervening elements, into the open end portions 21 of the housing 20 in such a manner that the couplings 30 are laterally adaptable along a centrally registered longitudinal axis of the housing 20. Each coupling 30 has a solid core 31 provided with a substantially linear bore 32 formed at an angle offset from a vertical axis. Of course, the couplings 30 may be provided with more than one bore 32 formed at various angles in order to effectively receive multiple support shafts 40 (described herein below) therein, as is obvious to a person of ordinary skill in the art.

Referring to FIGS. 4 through 7, each bore 32 is provided with a longitudinal axis outwardly flaring away from a center of the housing 20, which is essential and advantageous for assisting the cord 25 (described herein below) to maintain a consistent and sufficient tension during operating conditions. This feature is vital such that the clothes suspended from the cord 25 do not come in contact with a ground surface as the cord 25 bows under a weight thereof. The longitudinal axes of the bores 32 are outwardly flanged away from a rear surface of the vehicle 11, which is important for effectively providing adequate space along which to hang clothing garments and the like without touching the vehicle 11. Each coupling 30 further has a hole 33 formed therein which is vertically positional with an associated one of the apertures 23 during assembly procedures. Such holes 33 are medially disposed from the bores 32 such that a user must remove the pins 24 (described herein below) from the apertures 23 prior to positioning the support shafts 40 into the bores 32.

Referring to FIGS. 1, 2, 4 and 5, a plurality of quick-release pins 24 are removably insertable into corresponding ones of the apertures 23 and holes 33, which is vital for effectively maintaining the couplings 30 at a static spatial relationship with the housing 20 during traveling conditions. This feature advantageously prevents the couplings 30 from falling out of the housing 20 while traveling, which would render the assembly useless.

Figure 3:
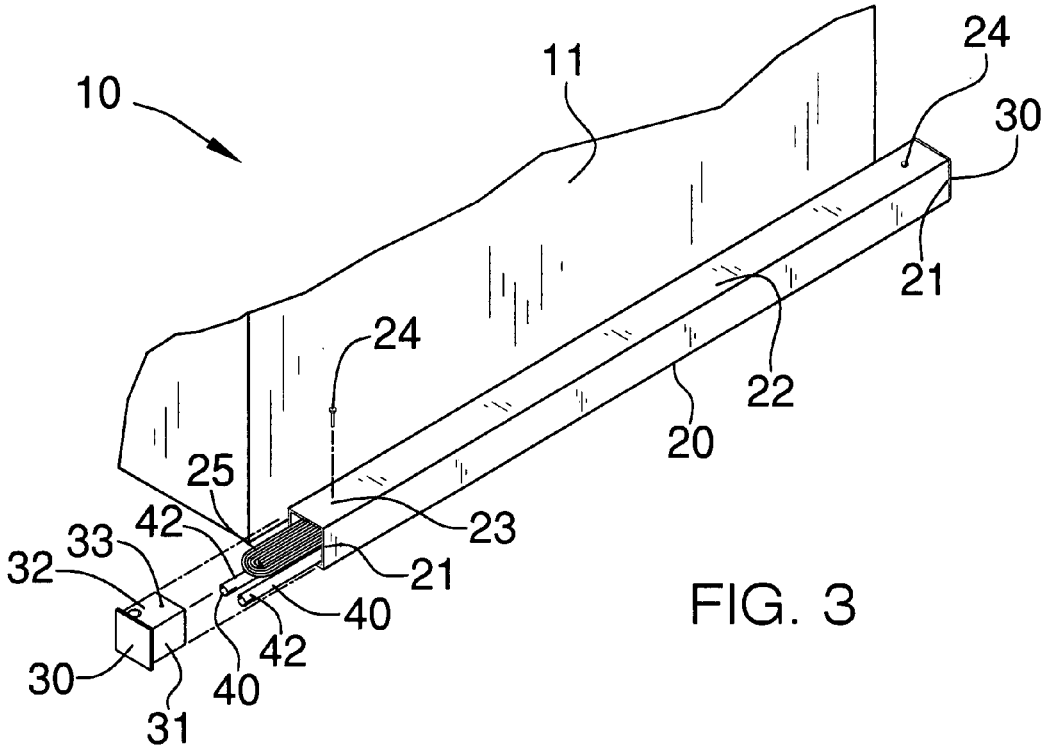
FIG. 3 is a perspective view of the assembly shown in FIG. 1, showing the storage location of the components within the housing.
Figure 4:
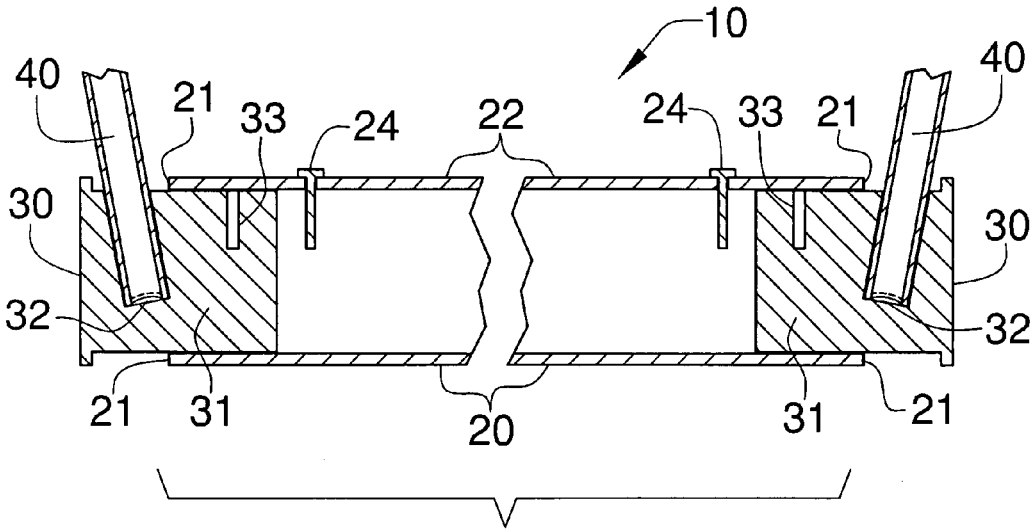
FIG. 4 is a cross-sectional view of the assembly shown in FIG. 1, taken along line 4-4.
Figure 5:
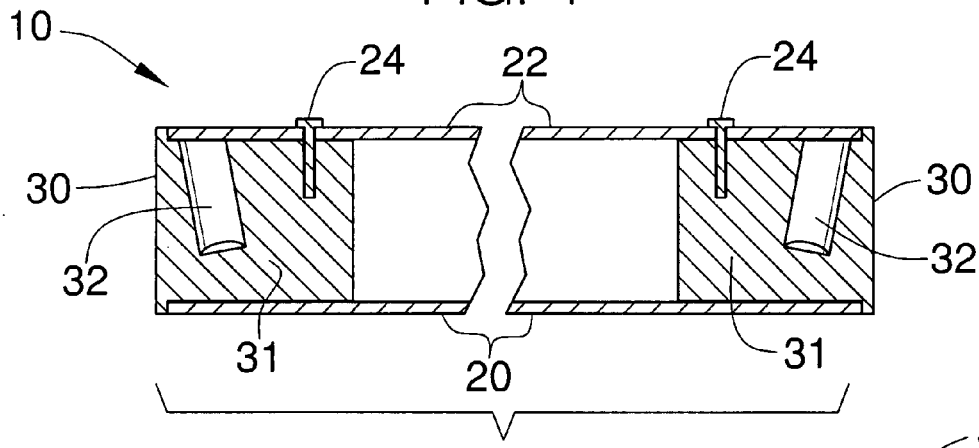
FIG. 5 is a cross-sectional view of the assembly shown in FIG. 2, taken along line 5-5.
Figure 6:
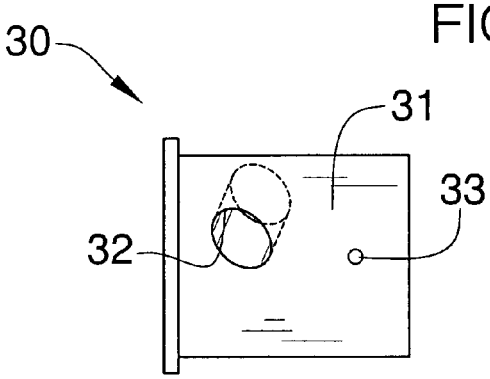
FIG. 6 is a top plan view of the left coupling shown in FIG. 1.
Figure 7:
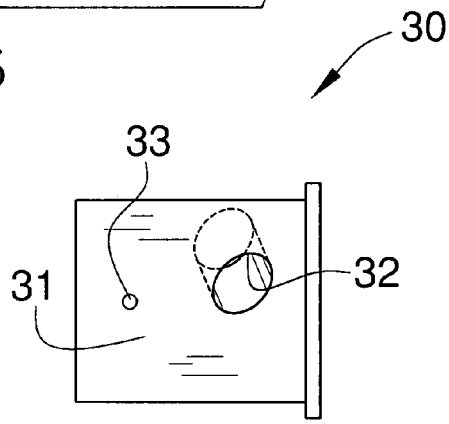
FIG. 7 is a top plan view of the right coupling shown in FIG. 1.
Figure 8:
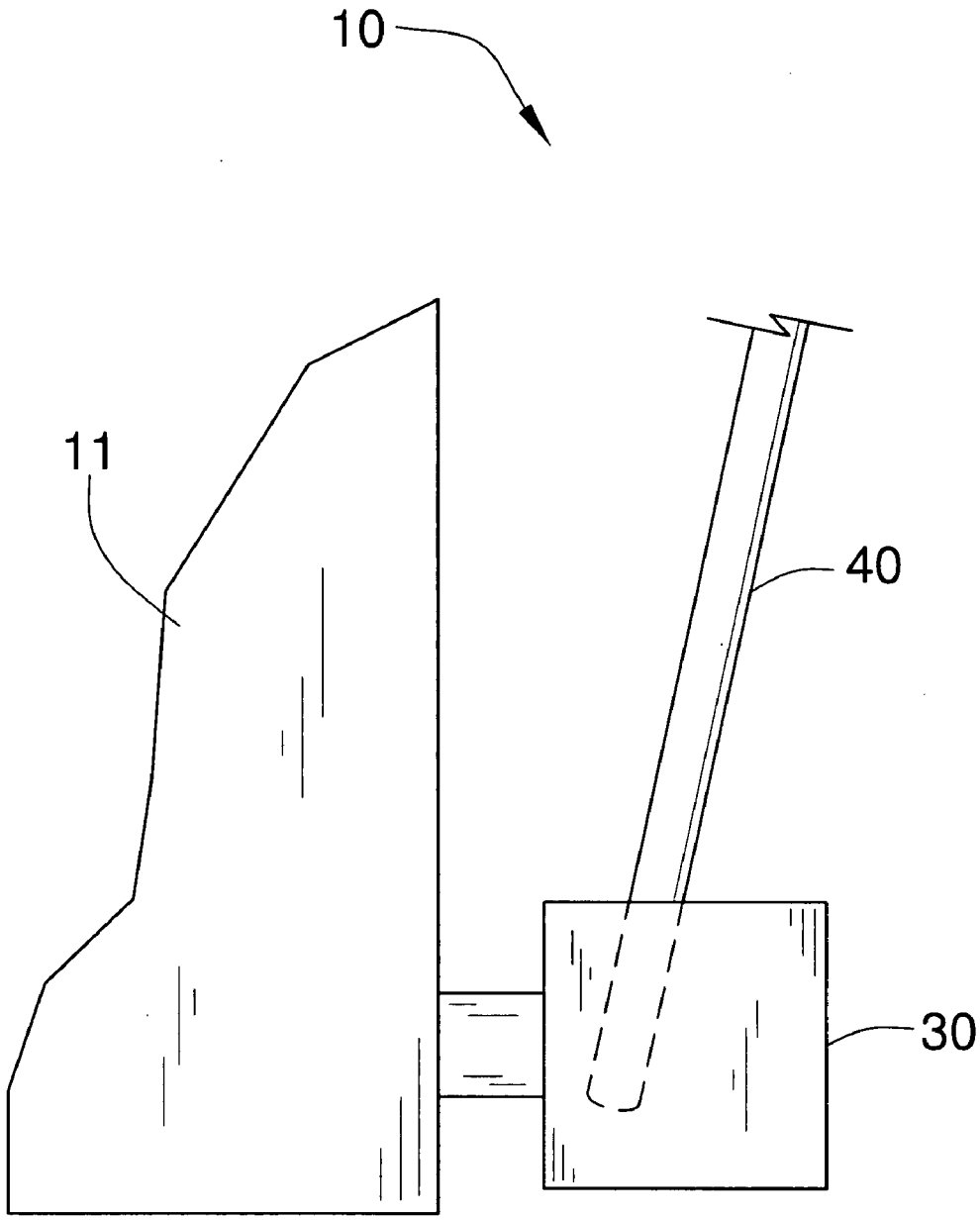
FIG. 8 is an enlarged side elevational view of the assembly shown in FIG. 1.

Referring to FIGS. 1, 3, 4 and 8, a plurality of coextensive elongated and linear support shafts 40 are sized and shaped for being conveniently stored within the housing 20 during traveling conditions, as is best shown in FIG. 3. This feature advantageously enables the assembly 10 to consume much less space during periods of non-use than similar types of assemblies known in the prior art. Such support shafts 40 are interfittable directly, with no intervening elements, into the bores 32 after the couplings 30 are partially and laterally displaced from the housing 20. The support shafts 40 have top end portions 41 provided with a plurality of eyelets 42 for respectively receiving the end portions 26 of the cord 25 therethrough.

Referring to FIGS. 1 and 3, a flexible cord 25 that has opposed end portions 26 is detachably tethered to the support shafts 40 in such a manner that the cord 25 maintains a sufficient tension that is critical for conveniently and advantageously supporting wet clothes therefrom during operating conditions. Of course, the support shaft 40 may be provided with multiple eyelets 42 positioned along a longitudinal length thereof and a plurality of cords 25 for being connected to corresponding pairs of eyelets 42, providing an increased surface for suspending clothes, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A clothesline assembly for use during camping trips and the like, said clothesline assembly comprising:

an elongated housing having a tubular shape provided with axially opposed open end portions abutted adjacent a rear portion of the vehicle, said housing having a planar top surface provided with a plurality of spaced apertures formed adjacent said end portions thereof;

a plurality of couplings directly insertable into said end portions of said housing in such a manner that said couplings are laterally adaptable along a centrally registered longitudinal axis of said housing, each said couplings having a solid core provided with a substantially linear bore formed at an angle offset from a vertical axis, each said couplings further having a hole formed therein which is vertically positional with an associated one of the apertures during assembly procedures;

a plurality of quick-release pins removably insertable into corresponding ones of the apertures and holes for maintaining said couplings at a static spatial relationship with said housing during traveling conditions;

a plurality of elongated and linear support shafts sized and shaped for being stored within said housing during traveling conditions, said support shafts being interfittab!e directly into the bores after said couplings are partially and laterally displaced from said housing; and a flexible cord having opposed end portions detachably tethered to said support shafts in such a manner that said cord maintains a sufficient tension for supporting wet clothes therefrom during operating conditions.

2. The portable clothesline assembly of claim 1, wherein said support shafts have top end portions provided with a plurality of eyelets for respectively receiving said end portions of said cord therethrough.

3. The portable clothesline assembly of claim 1, wherein each of the bores is provided with a longitudinal axis outwardly flaring away from a center of said housing for assisting said cord to maintain a consistent and sufficient tension during operating conditions.

4. The portable clothesline assembly of claim 1, wherein the holes are medially disposed from the bores such that a user must remove said pins from the apertures prior to positioning said support shafts into the bores.

5. The portable clothesline assembly of claim 1, wherein the longitudinal axes of the bores are outwardly flanged away from a rear surface of the vehicle for providing adequate space along which to hang clothing garments and the like.

6. A clothesline assembly for use during camping trips and the like, said clothesline assembly comprising:

an elongated housing having a tubular shape provided with axially opposed open end portions abutted adjacent a rear portion of the vehicle, said housing having a planar top surface provided with a plurality of spaced apertures formed adjacent said end portions thereof, said housing being formed from durable and non-corrosive material;

a plurality of couplings directly insertable into said end portions of said housing in such a manner that said couplings are laterally adaptable along a centrally registered longitudinal axis of said housing, each said couplings having a solid core provided with a substantially linear bore formed at an angle offset from a vertical axis, each said couplings further having a hole formed therein which is vertically positional with an associated one of the apertures during assembly procedures;

a plurality of quick-release pins removably insertable into corresponding ones of the apertures and holes for maintaining said couplings at a static spatial relationship with said housing during traveling conditions;

a plurality of elongated and linear support shafts sized and shaped for being stored within said housing during traveling conditions, said support shafts being interfittable directly into the bores after said couplings are partially and laterally displaced from said housing; and a flexible cord having opposed end portions detachably tethered to said support shafts in such a manner that said cord maintains a sufficient tension for supporting wet clothes therefrom during operating conditions.

7. The portable clothesline assembly of claim 6, wherein said support shafts have top end portions provided with a plurality of eyelets for respectively receiving said end portions of said cord therethrough.

8. The portable clothesline assembly of claim 6, wherein each of the bores is provided with a longitudinal axis outwardly flaring away from a center of said housing for assisting said cord to maintain a consistent and sufficient tension during operating conditions.

9. The portable clothesline assembly of claim 6, wherein the holes are medially disposed from the bores such that a user must remove said pins from the apertures prior to positioning said support shafts into the bores.

10. The portable clothesline assembly of claim 6, wherein the longitudinal axes of the bores are outwardly flanged away from a rear surface of the vehicle for providing adequate space along which to hang clothing garments and the like.

11. A clothesline assembly for use during camping trips and the like, said clothesline assembly comprising:

an elongated housing having a tubular shape provided with axially opposed open end portions abutted adjacent a rear portion of the vehicle, said housing having a planar top surface provided with a plurality of spaced apertures formed adjacent said end portions thereof, said housing being formed from durable and non-corrosive material;

a plurality of couplings directly insertable into said end portions of said housing in such a manner that said couplings are laterally adaptable along a centrally registered longitudinal axis of said housing, each said couplings having a solid core provided with a substantially linear bore formed at an angle offset from a vertical axis, each said couplings further having a hole formed therein which is vertically positional with an associated one of the apertures during assembly procedures;

a plurality of quick-release pins removably insertable into corresponding ones of the apertures and holes for maintaining said couplings at a static spatial relationship with said housing during traveling conditions;

a plurality of coextensive elongated and linear support shafts sized and shaped for being stored within said housing during traveling conditions, said support shafts being interfittable directly into the bores after said couplings are partially and laterally displaced from said housing; and a flexible cord having opposed end portions detachably tethered to said support shafts in such a manner that said cord maintains a sufficient tension for supporting wet clothes therefrom during operating conditions.

12. The portable clothesline assembly of claim 11, wherein said support shafts have top end portions provided with a plurality of eyelets for respectively receiving said end portions of said cord therethrough.

13. The portable clothesline assembly of claim 11, wherein each of the bores is provided with a longitudinal axis outwardly flaring away from a center of said housing for assisting said cord to maintain a consistent and sufficient tension during operating conditions.

14. The portable clothesline assembly of claim 11, wherein the holes are medially disposed from the bores such that a user must remove said pins from the apertures prior to positioning said support shafts into the bores.

15. The portable clothesline assembly of claim 11, wherein the longitudinal axes of the bores are outwardly flanged away from a rear surface of the vehicle for providing adequate space along which to hang clothing garments and the like.

* * * * *